US005690027A

United States Patent [19]

Takahashi et al.

[11] Patent Number: 5,690,027

[45] Date of Patent: Nov. 25, 1997

[54] STENCIL PRINTER HAVING INK LEAKAGE PREVENTING CONSTRUCTION

[75] Inventors: Yasuhiro Takahashi; Koji Nakayama, both of Inashiki-gun, Japan

[73] Assignee: Riso Kagaku Corporation, Tokyo, Japan

[21] Appl. No.: 685,719

[22] Filed: Jul. 24, 1996

[30] Foreign Application Priority Data

Jul. 31, 1995 [JP] Japan ..... 7-214075

[51] Int. Cl.[6] ..... B41L 13/06

[52] U.S. Cl. ..... 101/120; 101/119

[58] Field of Search ..... 101/120, 119, 101/116, 117, 118

[56] References Cited

U.S. PATENT DOCUMENTS

| | | | |
|---|---|---|---|
| 1,597,250 | 8/1926 | Rowley | 101/116 |
| 3,283,710 | 11/1966 | Zahradnik et al. | 101/118 |
| 5,081,924 | 1/1992 | Ohinata | 101/120 |

FOREIGN PATENT DOCUMENTS

| | | |
|---|---|---|
| 0-529-215 | 3/1993 | European Pat. Off. . |
| 1-204781 | 8/1989 | Japan . |
| 2-225078 | 9/1990 | Japan . |
| 4-105984 | 4/1992 | Japan . |
| 4-361043 | 12/1992 | Japan . |
| 7-137415 | 5/1995 | Japan . |
| 7-137416 | 5/1995 | Japan . |
| 7-137419 | 5/1995 | Japan . |
| 7-179014 | 7/1995 | Japan . |

*Primary Examiner*—Edgar S. Burr
*Assistant Examiner*—Daniel J. Colilla
*Attorney, Agent, or Firm*—Oliff & Berridge

[57] ABSTRACT

In a stencil printer having a printing drum 10 which has a circumferential wall portion for mounting a stencil sheet made of a flexible sheet member 20 and including a perforated portion 20*c*, an inking roller 12 provided inside of the printing drum for supplying ink to the printing drum from its inside, and a back press roller 14 for supporting a print sheet against the printing drum by holding a leading end of the print sheet by clamps 25, a strip of elastic sheet 52 is provided to prevent ink leakage from the perforated portion 20*c* of the printing drum due to insufficient support of the print sheet by the back press roller at the portion of the clamps 25.

3 Claims, 3 Drawing Sheets

STENCIL PRINTER HAVING INK LEAKAGE PREVENTING CONSTRUCTION

BACKGROUND OF THE INVENTION

1. Field of the Invention

The present invention relates to a stencil printer, and more particularly to a construction for preventing ink leakage from a printing drum of the stencil printer.

2. Description of the Prior Art

A stencil printer comprising a printing drum having a perforated construction at a circumferential portion thereof except two annular edge portions extending along opposite axial ends of a cylindrical configuration thereof and a strip of stencil sheet leading end mounting portion extending between said two annular edge portions along a generatrix of the cylindrical configuration, an inking roller provided inside of said printing drum so as to supply ink to said perforated circumferential portion of said printing drum from the inside thereof, and a back press roller, said printing drum and said back press roller being arranged in proximity and parallel to one another and adapted to rotate in synchronization with one another in opposite directions so as to execute a stencil printing such that the ink supplied to said perforated portion of said printing drum by said inking roller is selectively transferred through a stencil sheet mounted around said printing drum to provide a printed image of ink on a print sheet supplied between said printing drum and said back press roller, is shown in Japanese Patent Application 63-28553 (Laid-open Publication 1-204781), Japanese Patent Application 1-47029 (Laid-open Publication 2-225078) and Japanese Patent Application 2-223550 (Laid-open Publication 4-105984) filed by the same assignee as the present application.

Further, in a stencil printer having the above-mentioned construction, it is also known to provide a clamp at the back press roller for holding the leading end of a print sheet so as to remove the print sheet from the perforated circumferential portion of the printing drum at a condition that an ink layer contained in the perforated portion is retained from moving by the inking roller so that a clear uniform print image is available with no dim print portion being caused due to an insufficiency of ink, while avoiding that the back of a print sheet laid above another is stained by the ink image of the lower print sheet, as described in Japanese Patent Application 3-162218 (Laid-open Publication 4-361043) filed by the same assignee as the present application. Still further, there has been proposed a stencil printer having a construction by which it is prevented that ink leaks from the perforated portion to an adjacent non-perforated portion of the printing drum even when the relative rotational position between the printing drum and the back press roller is changed within a predetermined range for adjusting the longitudinal position of the print image relative to a print sheet mounted on the back press roller with its leading end being held to the back press roller by a clamp, as described in Japanese Patent Application 6-66708 (Laid-open Publication 7-179014) filed by the same assignee as the present application.

The stencil printer according to the above-mentioned Japanese Patent Application 6-66708 is constructed such that, in order to prevent the above-mentioned ink leakage, the circumferential length of each of the perforated portion of the printing drum and the transverse groove of the back press roller and the relative rotational phase between said perforated portion and said transverse groove are so determined that said perforated portion and said transverse groove do not lie one over the other, so that therefore the perforated portion of the printing drum is always firmly supported by the cylindrical outer circumferential surface of the back press roller when the perforated portion is applied with the ink supply pressing by the inking roller from the inside thereof, or in other words, it is avoided that the perforated portion of the printing drum is pressed by the inking roller from the inside thereof in a condition not supported at the outside thereof as it is exposed to the transverse groove of the back press roller.

However, although the clamp provided at the outer circumferential surface of the back press roller adjacent a transverse groove for holding the leading end of a print sheet is constructed to present an outer surface following as good the cylindrical configuration of the outer circumferential surface of the back press roller as possible, there remains necessarily a clearance around the clamp since it is a movable member, and therefore the back press roller can not present a perfect cylindrical outer surface in this area. Particularly when the clamp is of an inclining type, a relatively large clearance is required to allow the clamp to incline to its open position. This situation will be described with reference to the drawing.

FIG. 1 of the attached drawing is the same as FIG. 1 of the above-mentioned Japanese Patent Application 6-66708, showing diagrammatically the basic construction of an embodiment of the stencil printer of said prior application. In this figure, 10 is a printing drum, and 14 is a back press roller. The printing drum 10 is constructed to have a pair of annular portion 16 at opposite axial ends thereof which are connected with one another by a transverse bar member 18 extending along a generatrix of the cylindrical configuration of the printing drum, thereby constructing a frame of the printing drum. A flexible sheet member 20 having a rectangular configuration in development is mounted such that opposite side edge portions thereof are laid over the outer circumferential surface of the pair of annular portions 16, while its leading end portion 20*a* and its trailing end portion 20*b* are respectively mounted to the transverse bar member 18. Although in the figure the mounting of the leading end portion 20*a* and the trailing end portion 20*b* of the flexible sheet member to the transverse bar member 18 is diagrammatically shown as simply laid one over the other at a corresponding portion thereof, particular mounting constructions of the trailing end portion 20*b* to the transverse bar member 18 are described in the above-mentioned Japanese Patent Application 1-47029 and also in Japanese Patent Application 5-306028 (Laid-open Publication 7-137415) and Japanese Patent Application 5-306029 (Laid-open Publication 7-137416) filed by the same assignee as the present application. A stencil sheet 19 is mounted around the cylindrical surface of the printing drum 10 defined by the flexible sheet member 20 with its leading end portion being mounted to the transverse bar member 18 by a clamp 21. Since the construction of mounting the leading and trailing end portions of the flexible sheet member to the transverse bar member is not concerned with the gist of the present invention, further description and illustration of such mounting construction will be omitted.

The flexible sheet member 20 has a non-perforated construction at both the leading end portion 20*a* and the trailing end portion 20*b* and has a perforated construction to pass ink therethrough at an intermediate perforated portion 20*c*. In the assembled construction, the non-perforated leading and trailing end portions 20*a* and 20*b* of the flexible sheet member 20 cooperate with the transverse bar member 18 to provide a strip of non-perforated stencil sheet leading end mounting portion 10*a* extending between the opposite axial ends of the printing drum 10 along a generatrix thereof.

On the other hand, the back press roller 14 is formed with a transverse groove 22 extending along a generatrix thereof. The printing drum 10 and the back press roller 14 are of the same diameter with one another and are adapted to be rotated in mutually opposite directions in synchronization with one another such that the stencil sheet leading end mounting portion 10*a* of the printing drum aligns with the transverse groove 22 of the back press roller when they meet one another. The rotational direction of the printing drum 10 is anti-clockwise, while that of the back press roller 14 is clockwise, as viewed in FIG. 1.

Inside the printing drum 10, an inking roller 12 is provided so as to be rotated by a shaft 13 about a central axis thereof, with its outer circumferential surface contacting an inner circumferential surface of the printing drum 10. In order to avoid that during the rotation of the printing drum the inking roller 12 percussively contacts a rigid portion including the transverse bar member 18 in traversing, a cam 24 is provided at each of the pair of annular portions 16 over a region covering the transverse bar member 18, while an annular cam follower 23 to engage the cam means 24 is provided on the shaft 13 of the inking roller 12.

The back press roller 14 is provided with a clamp 25 adjacent a trailing edge of the transverse groove 22 as viewed in the direction of rotation of the back press roller for holding the leading end of a print sheet (not shown), so that the print sheet is tightly held on the circumferential surface of the back press roller 14 starting from the clamped leading end when the back press roller rotates clockwise in the figure, so that the print sheet is passed through a nip region between the back press roller and the printing drum to be provided with a print image thereon by the ink urged through the flexible sheet member 20 radially outwardly at the perforated portion 20*c* from its inside to its outside by the inking roller 12 and passed through perforated portions of the stencil sheet 19.

As will be appreciated from FIG. 1, according to the invention of Japanese Patent Application 6-66704, the outer circumferential length of each of the perforated portion 20*c* of the printing drum 10 and the transverse groove 22 of the back press roller 14, indicated by P and G, respectively, and herein called as the length along a cylindrical configuration of the printing drum or the back press roller, and the relative rotational phase between the perforated portion 20*c* and the transverse groove 22, are determined such that the perforated portion 20*c* does not overlap with the transverse groove 22, so as thereby to leave an outer circumferential portion 30 remained between a point (actually a line) 28 on the back press roller 14 corresponding to a point (actually a line) 26 bordering the perforated portion 20*c* and the non-perforated leading end portion 20*a* of the flexible sheet member and the transverse groove 22, while an outer circumferential portion 36 is also remained between a point (actually a line) 34 on the outer circumferential surface of the back press roller 14 corresponding to a point (actually a line) 32 bordering the perforated portion 20*c* and the non-perforated trailing end portion 20*b* and the transverse groove 22. By these outer circumferential portions 30 and 36 being remained on the back press roller 14, when the bordering point 26 or 36 and a part of the perforated portion 20*c* adjacent thereto pass the position of contact with the inking roller 12, even though ink would leak from the perforated portion 20*c* to the adjacent non-perforated portion by the squeezing action applied by the inking roller 12, such a leaking out of the ink is suppressed by the rigid cylindrical outer surface of the back press roller 14 being tightly pressed against the flexible sheet member, thereby effectively preventing such a leaking out of the ink onto the outside surface of the non-perforated portion 20*a* or 20*b*.

In Japanese Patent Application 5-306033 (Laid-open Publication 7-137419) filed by the same assignee as the present application, it was proposed to shift the relative rotational position between the printing drum 10 and the back press roller 14 from a standard position such as shown in FIG. 1 at which the transverse bar member 18 is just in alignment with the transverse groove 22, in opposite directions, for the purpose of adjusting the longitudinal position of a print image on a print sheet. When such a longitudinal print position adjustment mechanism is incorporated in the stencil printer, the point 28 on the back press roller 14 corresponding to the bordering point 26 on the printing drum 10 and the point 34 on the back press roller 14 corresponding to the bordering point 32 on the printing drum 10 move in biasing ranges 38 and 40, respectively. Therefore, if the circumferential length of the portions 30 and 36 are determined by taking those biasing ranges 38 and 40 into consideration, when such a longitudinal print position adjustment means is incorporated into the printer, the bordering point 26 or 32 and a part of the perforated portion 20*c* adjacent thereto will be retained from being exposed to the transverse groove 22 in traversing the position of contact with the inking roller 12, regardless of changes of the relative rotational phase between the printing drum 10 and the back press roller 14 effected by the longitudinal position adjustment means, so that the bordering point 26 or 32 and the part of the perforated portion 20*c* adjacent thereto are applied with the firm support of the rigid cylindrical outer circumference of the back press roller 14, so that no ink leakage from the perforated portion 20*c* to its adjacent non-perforated portion should occur.

However, when the clamp 25 is provided at the outer circumferential portion 30 of the back press roller 14, since there is necessarily formed a certain clearance around the clamp 25, as it has a movable construction, and particularly when the clamp is of a pivotally inclining type, a relatively large clearance 27 is formed, as shown in FIGS. 2 and 3, so that the back press roller can no longer present a perfect cylindrical outer surface at the portion 30. Therefore, when the perforated portion 20*c* is pressed by the inking roller 12 against the portion of the clearance, the outside support to the flexible sheet member becomes insufficient, whereby a press out of ink from the inside to the outside of the perforated portion 20*c* occurs as shown in FIG. 3. When such a press out of ink once occurs, the highly viscous ink does not return by itself to the inside of the perforated portion 20*c* even when the press action by the inking roller has been removed. Therefore, when such a process is repeated along with rotations of the printing drum, the ink flows unidirectionally across the perforated portion 20*c* at such a poor support portion from its inside to its outside such that there is generated a substantial accumulation of ink between the flexible sheet member 20 and the stencil sheet 19. If such an accumulation of ink progresses, there will occur an ink leakage therearound, causing a contamination by ink and even a damage of the stencil sheet by it being strongly pressed against an edge of the clamp or a notch for mounting the clamp.

SUMMARY OF THE INVENTION

In view of the above-mentioned problems caused by the unidirectional transfer of ink through the perforated portion of the printing drum due to a pressing of the perforated portion of the flexible sheet member by the inking roller against a clearance formed around the clamp of the back press roller, it is a principal object of the present invention to provide an improved stencil printer in which the contamination by ink and the damage of stencil sheet caused by the above-mentioned mechanism are effectively avoided.

According to the present invention, the above-mentioned object is accomplished by a stencil printer comprising a printing drum having a perforated construction at a circumferential portion thereof except two annular edge portions extending along opposite axial ends of a cylindrical configuration thereof and a strip of stencil sheet leading end mounting portion extending between said two annular edge portions along a generatrix of the cylindrical configuration, an inking roller provided inside of said printing drum so as to supply ink to said perforated circumferential portion of said printing drum from the inside thereof, and a back press roller having a clamp for mounting a leading end of a print sheet thereto provided along a generatrix thereof, said printing drum and said back press roller being arranged in proximity and parallel to one another and adapted to rotate in directions opposite to one another so as to execute a stencil printing such that the ink supplied to said perforated portion of said printing drum by said inking roller is selectively transferred through a stencil sheet mounted around said printing drum to provide a printed image of ink on a print sheet supplied between said printing drum and said back press roller with a leading end portion thereof being held by said clamp, wherein the stencil printer further comprises a strip of elastic sheet mounted on said back press roller along a generatrix thereof so as to cover said clamp.

By such a clamp covering sheet being provided, regardless whether the above-mentioned longitudinal print position adjustment means is provided or not, even when the perforated portion of the flexible sheet member is pressed by the inking roller against the back press roller with the clamp being aligned thereto, the perforated portion of the flexible sheet member is sufficiently supported by the elastic sheet covering the clamp, so that an accumulation of ink such as shown in FIG. 3 is effectively avoided.

Particularly when the clamp is of a pivotally inclining type, said strip of elastic sheet may be formed with slits corresponding to opposite side edges of the clamp, so that when the clamp inclines outwardly, a part of the elastic sheet lying over the clamp can elastically bend up separately from adjacent portions thereof extending on opposite sides thereof along the slits, while when the clamp is returned to its clamping position, the part can return by following the clamp to the position of continually aligning with the opposite side portions to present the original strip form.

Said clamp may constructed to include a plurality of such clamps spaced along the generatrix, while said elastic sheet may be an elongated sheet continually extending over said plurality of clamps with a plurality of pairs of said slits formed as spaced therealong to correspond to each one of said plurality of clamps.

BRIEF DESCRIPTION OF THE DRAWING

In the accompanying drawing.

DESCRIPTION OF THE PREFERRED EMBODIMENT

Figure 1:
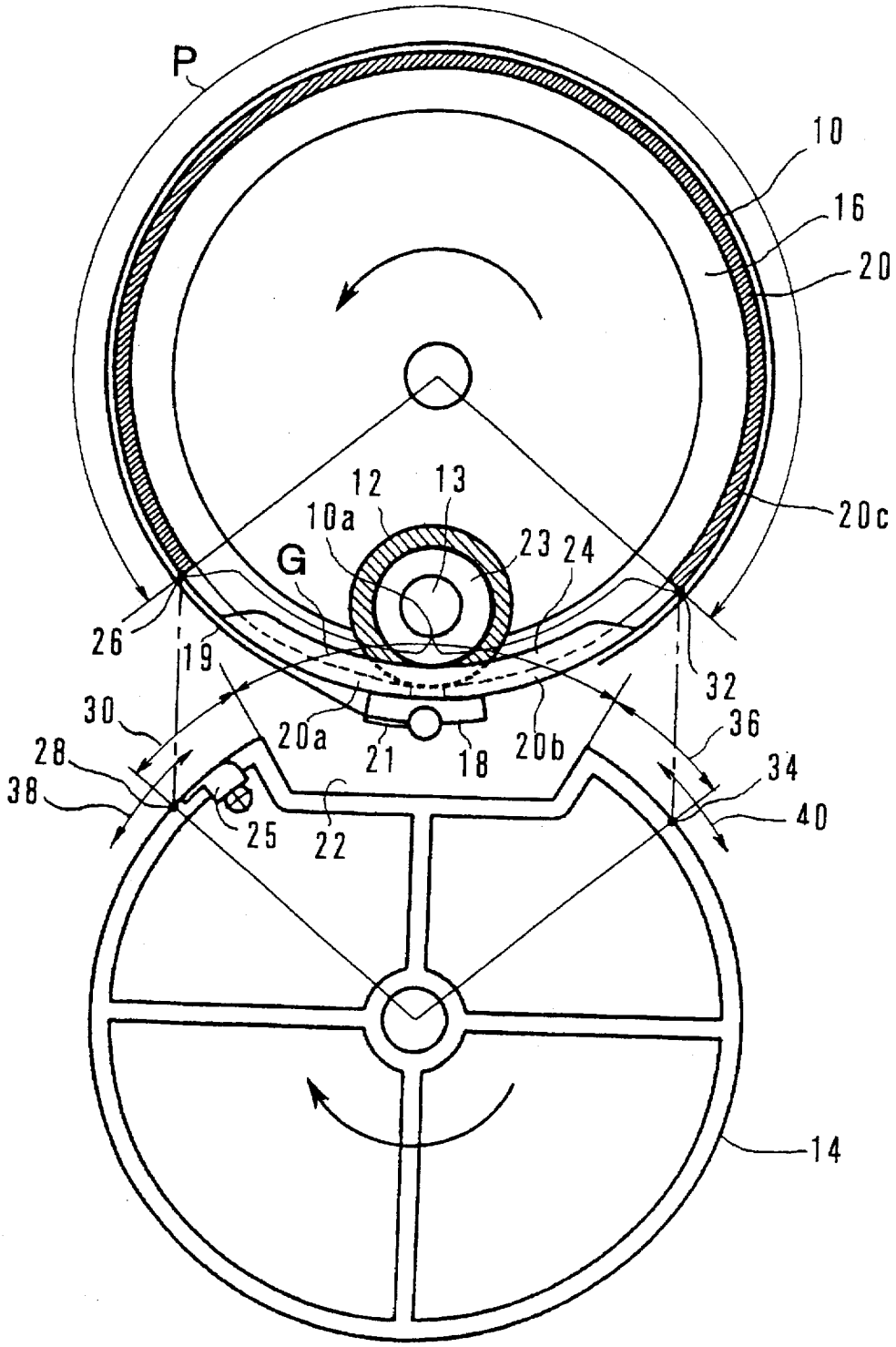
FIG. 1 PRIOR ART
FIG. 1 is a diagrammatic view showing the construction of the essential portions of a prior art stencil printer having the problems solved by the present invention.
Figure 2:
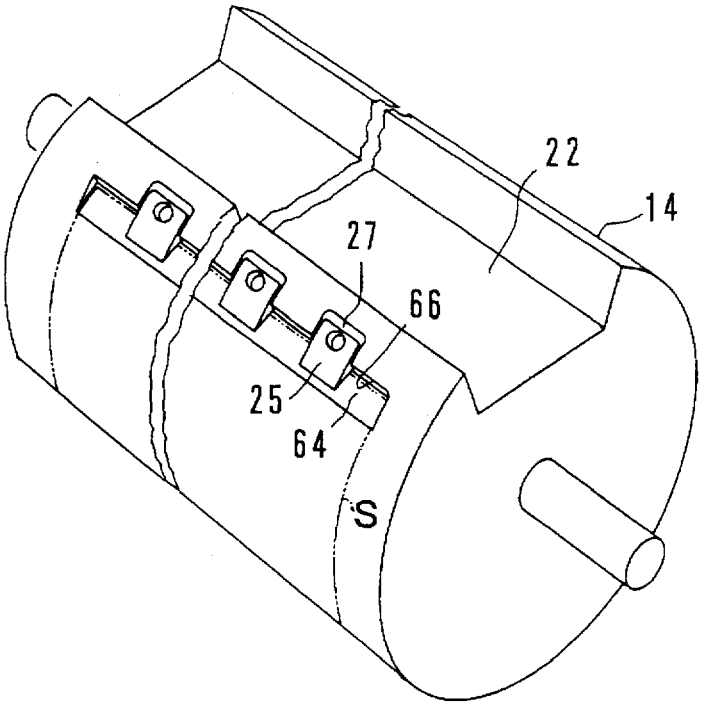
FIG. 2 PRIOR ART
FIG. 2 is a perspective view showing an example of the back press roller of the stencil printer shown in FIG. 1.
Figure 4:
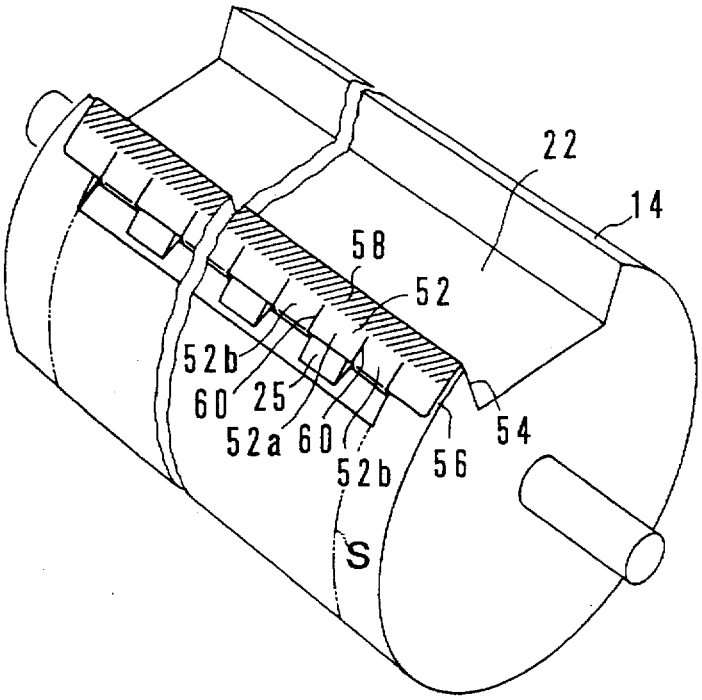
FIG. 4 is a perspective view of a back press roller similar to that shown in FIG. 2, incorporating the present invention in the form of an embodiment thereof.
Figure 3:
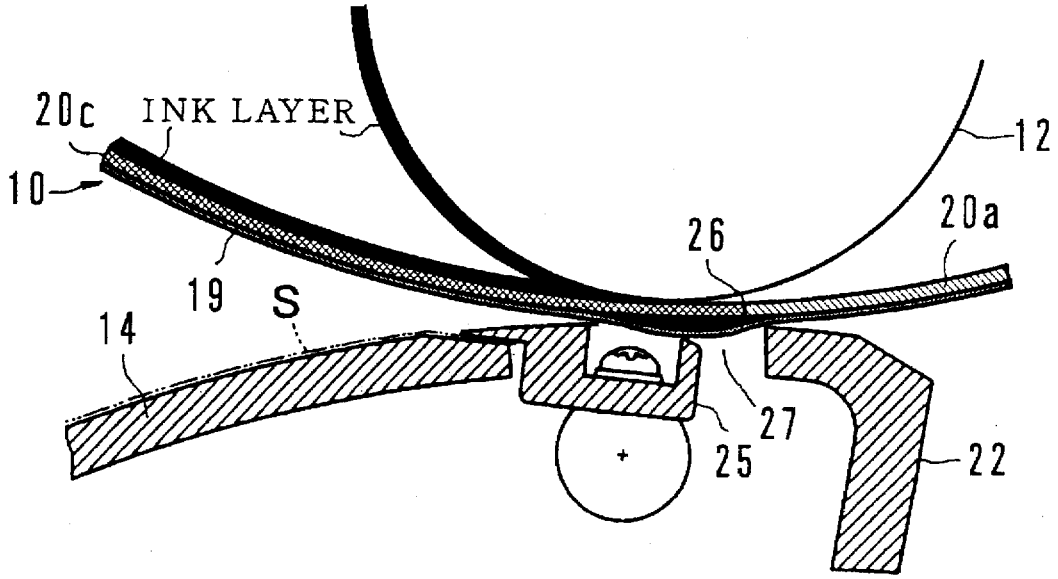
FIG. 3 PRIOR ART
FIG. 3 is an enlarged view of a part of the stencil printer shown in FIG. 1, illustrating the problems solved by the present invention.
Figure 5:
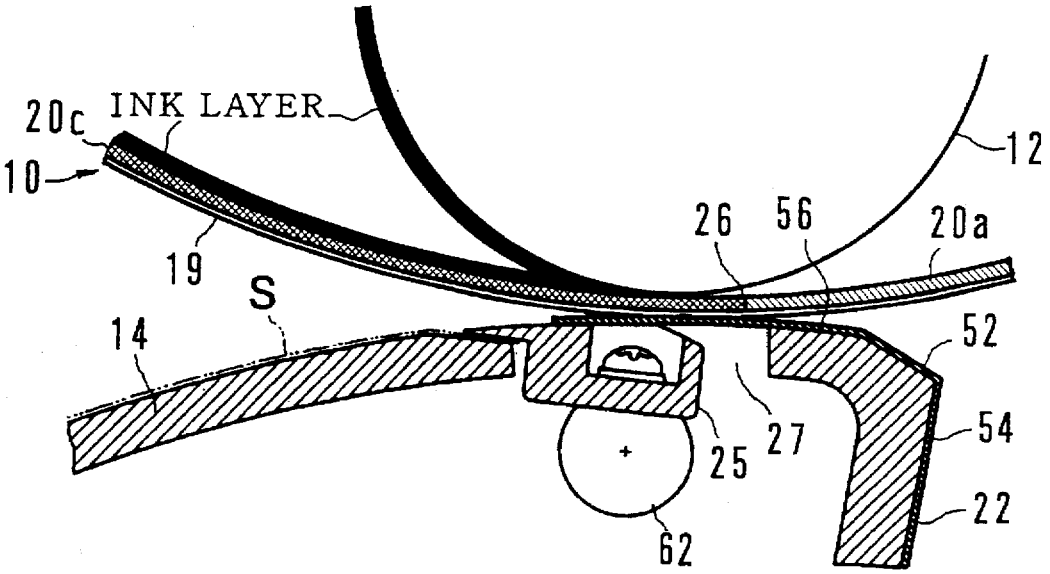
FIG. 5 is a cross sectional view showing the operation of the essential parts of the strip of elastic sheet according to the present invention being incorporated into the back press roller.

FIG. 4 is a somewhat diagrammatic perspective view similar to FIG. 2, showing an embodiment of the above-mentioned strip of elastic sheet according to the present invention being incorporated into the back press roller shown in FIG. 2, and FIG. 5 is a cross sectional view showing the operation of the essential parts thereof in a manner similar to FIG. 3. In these figures, 52 is the above-mentioned strip of elastic sheet. In the shown embodiment, it is a strip of elastic sheet having an L-shaped cross section arranged along one of the side edges the transverse groove 22 closer to the clamp 25 so as to extend from an end wall 54 of the transverse groove to a strip of outer circumferential surface portion 56 and is fastened by an adhesive at a portion thereof facing the end wall 54 and a strip portion 58 hatched in FIG. 4 to the corresponding surface of the back press roller. Such a strip of elastic sheet may be made from a very thin sheet material having a thickness of about 0.1 mm of stainless steel, phosphor bronze, elastic polyester, or other proper elastic material.

In the shown embodiment, the clamp 25 is of a pivotally inclining type, and a plurality of such clamps are arranged in the axial direction of the back press roller along the transverse groove 22. The strip of elastic sheet 52 is formed with slits 60 corresponding to opposite side edges of each of the clamps 25. By the strip of elastic sheet being formed with these slits, when the clamps 25 are turned by a support shaft 62 in clockwise as viewed in FIG. 5 to open the clamps, the portions **52*a* lying over the clamps are separated from the adjacent portions 52*b* along the slits 60 so as to be able to readily follow the inclining clamps according to an elastic bending. In the shown embodiment, the portions 52*b* are each bent at a tip portion thereof so as to follow an end face 66 (FIG. 2) of an indent 64** having a triangular cross section left on opposite sides of each of the clamps.

By such a strip of elastic sheet 52 being provided to cover clearances 27 for allowing the clamps to turn up, even when the perforated portion **20*c* of the flexible sheet member is pressed by the inking roller 12 against the portion of the back press roller where the clamp 25 and the clearances 27 are provided, the perforated portion 20*c*** is given an outside support firm enough to prevent the ink from flowing out therethrough.

Although the stencil printer of the above described embodiment has the construction that the circumferential portion of the printing drum made of the flexible sheet member is pushed out by the inking roller for executing the printing, the present invention is also applicable to those stencil printers in which the back press roller is moved toward the printing drum for executing the printing.

Further, although the present invention has been described in detail in the above with respect to an embodiment incorporated into the back press roller having those particular clamps as shown in FIG. 2, it will be apparent for those skilled in the art that the present invention is not restricted to such a particular embodiment, and that the strip of elastic sheet may be made to have any appropriate construction or configuration according to the construction or configuration of the clamps.

We claim:

1. A stencil printer comprising a printing drum having a perforated construction at a circumferential portion thereof except two annular edge portions extending along opposite axial ends of a cylindrical configuration thereof and a strip of stencil sheet leading end mounting portion extending between said two annular edge portions along a generatrix of the cylindrical configuration, an inking roller provided inside of said printing drum so as to supply ink to said perforated circumferential portion of said printing drum from the inside thereof, and a back press roller having a clamp for mounting a leading end of a print sheet thereto provided along a generatrix thereof, said printing drum and said back press roller being arranged in proximity and parallel to one another and adapted to rotate in directions opposite to one another so as to execute a stencil printing such that the ink supplied to said perforated portion of said printing drum by said inking roller is selectively transferred through a stencil sheet mounted around said printing drum to provide a printed image of ink on a print sheet supplied between said printing drum and said back press roller with a leading end portion thereof being held by said clamp, wherein the stencil printer further comprises a strip of elastic sheet mounted on said back press roller along a generatrix thereof so as to cover said clamp.

2. A stencil printer according to claim 1, wherein said clamp is of a pivotally inclining type, and said elastic sheet is formed with slits corresponding to opposite side edges of said clamp.

3. A stencil printer according to claim 2, wherein said clamp is constructed to include a plurality of such clamps spaced along the generatrix, while said elastic sheet is an elongated sheet continually extending over said plurality of clamps with a plurality of pairs of said slits formed as spaced therealong to correspond to each one of said plurality of clamps.

* * * * *